US005537896A

United States Patent [19]

Halder

[11] Patent Number: 5,537,896

[45] Date of Patent: Jul. 23, 1996

[54] NONMARRING HAMMER

[75] Inventor: Werner Halder, Achstetten, Germany

[73] Assignee: Erwin Halder KG, Achstetten, Germany

[21] Appl. No.: 388,048

[22] Filed: Feb. 9, 1995

[51] Int. Cl.[6] ..... B25D 1/14; B25D 1/12

[52] U.S. Cl. ..... 81/26; 81/22

[58] Field of Search ..... 81/22, 26, 20, 81/25, 27; 76/103, 119, 114

[56] References Cited

U.S. PATENT DOCUMENTS 1,674,999 6/1928 Sewell ..... 81/25
3,844,321 10/1974 Cook ..... 81/26
4,393,908 7/1983 Clay ..... 81/26
5,375,486 12/1994 Carmien ..... 81/22

FOREIGN PATENT DOCUMENTS 646775 11/1950 United Kingdom ..... 81/20

*Primary Examiner*—Bruce M. Kisliuk
*Assistant Examiner*—Joni B. Danganan
*Attorney, Agent, or Firm*—Herbert Dubno; Andrew Wilford

[57] ABSTRACT

A dead-blow nonmarring hammer has its head and handle portions unitarily formed on half shells which are welded together. Hammer face inserts are received in ends of the housing portion and impact plates can be provided inwardly of the inserts to protect the inserts against wear by the mobile mass within the housing.

14 Claims, 3 Drawing Sheets

16
2
1
7a
7
3
15
7a
13
7
14
8
2
II
II
12
11
9
10
10

6
4
7
16
5
7

NONMARRING HAMMER

FIELD OF THE INVENTION

My present invention relates to a nonmarring hammer having at least one hammer face insert receivable in a housing forming a head of the hammer and a shank for a hammer shaft adapted to constitute the handle connected to that housing.

BACKGROUND OF THE INVENTION

Nonmarring hammers which can be provided for imparting so-called dead blows to an object by reason of a mass within the hammer head or housing impacting upon an inner side face insert which may be of yieldable material to prevent damage to the surface of the object, are known and can comprise a steel tube having openings at its ends in which respective hammer face inserts are received. On an external surface of such a tubular housing, a shank is provided which can receive the hammer shaft which forms a handle of the nonmarring hammer. In general, that shaft shank is welded or soldered to the outer surface of the tubular housing.

In practice, however, it has been found that the welded or soldered connection between the housing and the shank is not always satisfactory since the housing can often release from the shank and fly away from the shank in an uncontrolled manner. This can occur even with perfect welds or solder joints, by reason of material fatigue or overstressing of the weld or solder joint, and, of course, may be more frequent in the case of poor solder joints or welds or connections which cannot be found to have defects by ordinary testing measures. The loss of the housing from the shaft of the hammer can cause injury to the user or to individuals in the vicinity and poses an unacceptable danger.

OBJECT OF THE INVENTION

It is, therefore, the principal object of the present invention to provide an improved nonmarring hammer in which the loss of the housing from the handle shank or shaft is practically excluded and the fundamental reliability of the hammer is maintained even in the case of high stresses.

It is another object of this invention to provide an improved nonmarring hammer of the dead-blow type whereby drawbacks of earlier systems are avoided.

It is also an object of this invention to provide an improved nonmarring hammer which can be fabricated simply and economically, has high strength, and does not depend on solder joints or welds between the handle shank and the housing provided with the hammer face insert or inserts.

SUMMARY OF THE INVENTION

These objects and others which will become apparent hereinafter are attained, in accordance with the invention, by forming the housing and the shank for the hammer shafts from two half shells which are assembled together and interconnect along a plane including the longitudinal axis of the hammer, the two shells being peripherally secured to one another, e.g. by welding and wherein each of the half shells is formed with a housing-forming portion and a shank-forming portion in one piece with the housing-forming portion. Each of the two half shells is thus provided in a single piece or in a unitary construction so that, when the two half shells are joined together, the resulting housing and tubular shank are interconnected by virtue of the one-piece construction of the half shells and do not require a solder joint or weld joint for such interconnection.

With the configuration of the invention, therefore, I am able to provide a nonmarring hammer whose tubular shank is integral with the tubular housing so that there is no danger of separation at a connection between the shank and the housing. Furthermore, the nonmarring hammer can be fabricated in a simple manner especially when both half shells are formed in one piece from a single sheet metal blank, preferably by a shaping from this blank in a material-removal-free manner.

In principle, the two half shells can be fabricated separately from one another, e.g. by stamping from sheet steel. It is, however, advantageous as noted for both half shells to be formed in one piece in a common sheet metal blank. The two half shells are interconnected at locations at which they are integral with one another and upon being bent into the configuration of the hammer, whereby the concave portions of the half shells face one another and the half shells are peripherally joined, e.g. by welding, the assembly is simple.

The half shells can be joined at any desired location although it has been found to be highly advantageous for maximum strength of the hammer and maximum ability to withstand the impact force, for the half shells to be joined together at the housing since then an enhanced strength is provided in the region at which the impact forces arise.

It has been found to be advantageous to have the edges at which the half shells are juxtaposed with one another or the surfaces at which the half shells abut one another to be peripherally welded together or otherwise joined in a non-releasable manner. The peripheral weld seam which is thus formed is generally free from substantial stress even during impact, unlike weld seams of prior art hammers which are provided between the housing and the shank.

In a further feature of the invention, at the transition regions between the housing and the shank, stiffening or strengthening ribs are provided which can be defined by edge strips of the half shells which are juxtaposed with one another and are welded together. These reinforcing ribs can lie in the plane at which the half shells are joined together and are welded together along the free edges of the ribs. The ribs thus have a dual function in that they serve to connect the shell halves together and provide reinforcement or greater strength especially in the region between the housing and the shank at which the greatest stress develops when the hammer is in use.

While the housing has at least one opening adapted to receive a hammer face insert, preferably the housing is open at both ends, respective nonmarring face inserts being received in both of these openings.

In each opening a respective impact plate is received with spacing from the rim or edge, preferably abutting the inner side of the respective insert and against which the movable mass within the housing can impact. The impact plates can be provided along their respective rims with collars which engage the edges of the respective openings and close these openings while having shoulders engaging the opening edges and welded or otherwise nonreleasably connected therewith.

In a preferred embodiment of the invention, the hollow interior of the housing is partly filled with shot or another movable mass having a damping effect upon any rebound of the hammer from a struck object. Advantageously, the shot or other movable mass is filled into the housing through a passage in the shank which can be releasably closed by a plug or the like so that even after the welding of the impact plate and the introduction of the movable mass, it is possible to increase the filling with shot or to replace the filling.

This permits variations in the damping effect to be achieved.

According to another feature of the invention, means is provided to limit relative rotation of the inserts or impact faces and the housing. Such means can include non-round configurations where the insert fits into the housing. For example, both the insert and the opening may be rectangular in configuration for this purpose.

The housing can be provided with ribs or rises embossed therein or formed out of the sheet metal of the housing for stiffening the housing walls. This permits relatively thin sheet metal to be used for the blank and for producing the half shells.

According to a particular feature of the invention, these ribs can extend parallel to the edges of the opening and form abutments for the impact plates.

The hammer shaft can be formed in one piece on the shank or with the shank. Especially effective results, however, are obtained for retaining the impact mass when the impact plates are provided with inwardly directed ribs for holding the impact mass. The impact plates can be formed onto the half shells and fabricated in one piece therewith. This, however, requires a greater width of the sheet metal blank.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
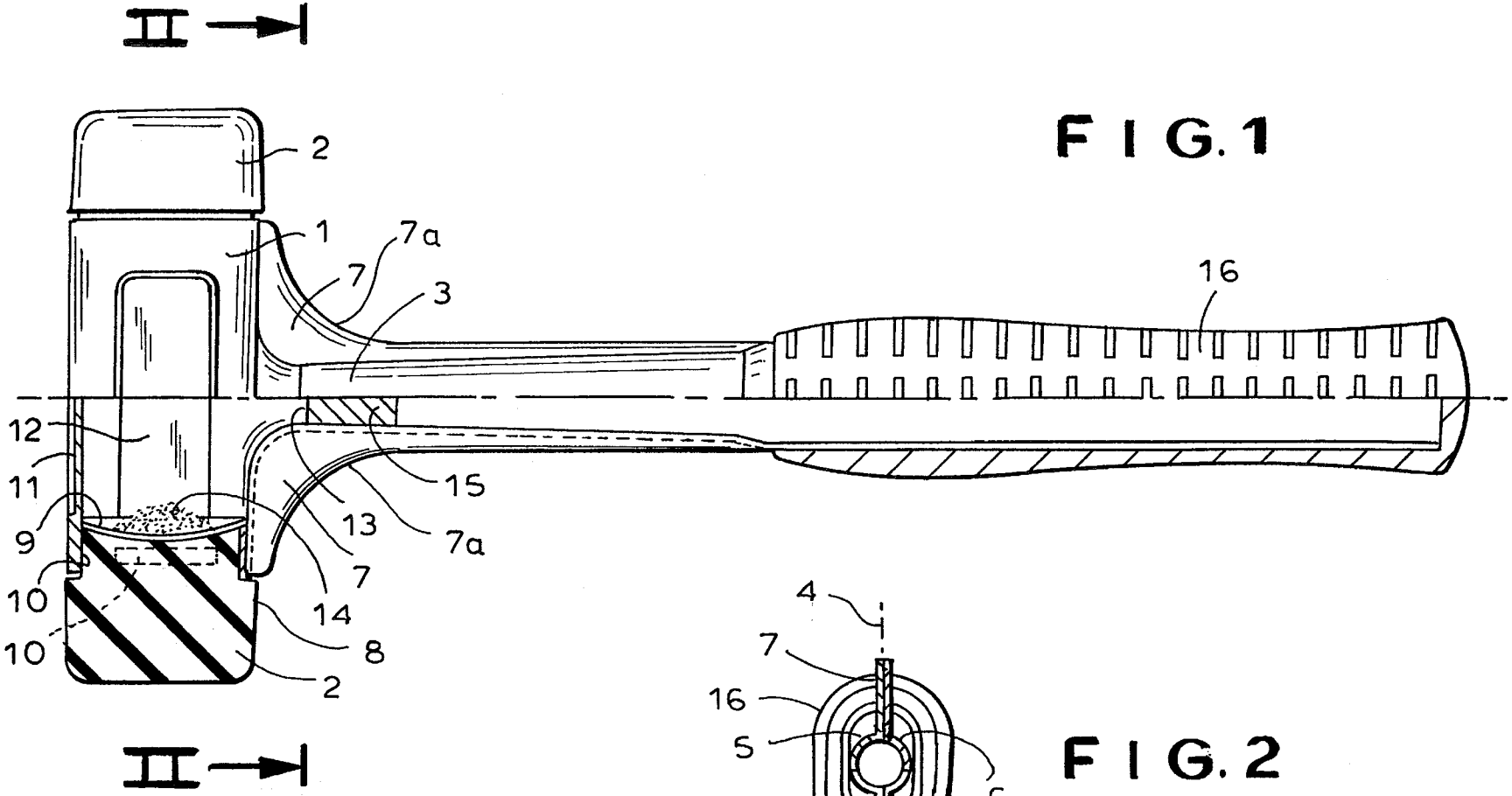
FIG. 1 is a Wide elevational view, partly in section of a nonmarring hammer according to the invention.
Figure 2:
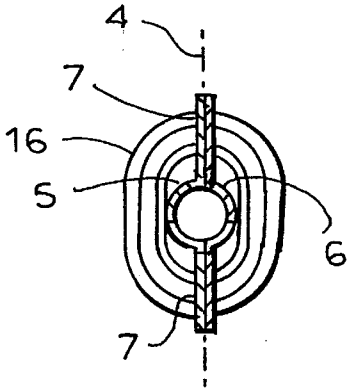
FIG. 2 is a section taken along the line II—II of FIG. 1.

The nonmarring hammer shown in the drawing comprises a housing 1 opening at opposite ends and there receiving hammer-face inserts 2 which can be composed of rubber or another material which does not mar the surface of the object to be hammered and which receives, in turn, a kinetic energy impulse from a mobile mass 14 within the hammer head or housing 1 when that mass impacts against an inner side of the insert 2.

From the hollow or tubular housing 1, a shank 3, also tubular or hollow extends transversely and can receive a hammer shaft 16 which can form a handle for the hammer.

The housing 1 and the shank 3 are formed by assembling two half shells 5 and 6 together, the half shells 5 and 6 being concave toward one another and adjoining in a plane of the longitudinal axes of the housing and the shank.

The two half shells 5 and 6 can be seamed together along their edges at which opposing abutment surfaces can engage. The seaming can be accomplished by a weld. The two half shells 5 and 6 each form a half of the shank 3 and a half of the housing 1, the housing portions and shaft portions of each half shell being unitary with one another.

Figure 3:
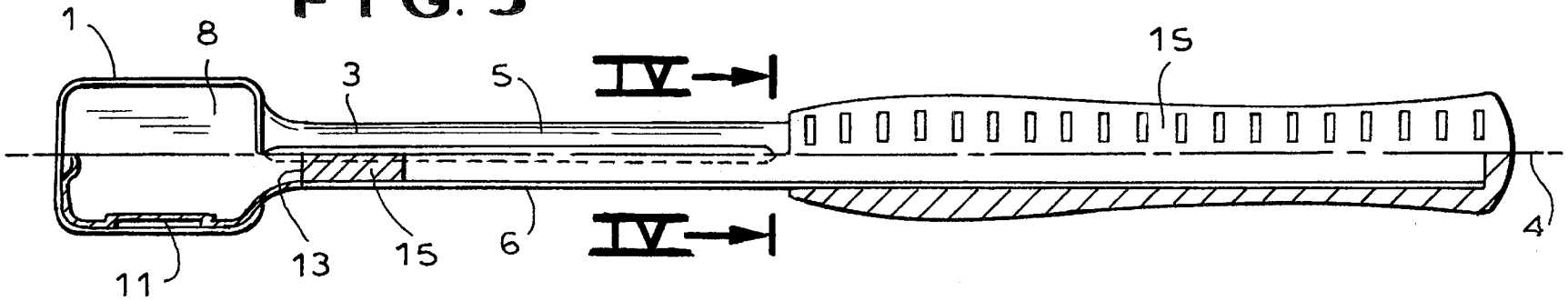
FIG. 3 is a plan view of the hammer of FIG. 1 also partially in section.
Figures 5, 8, 9:
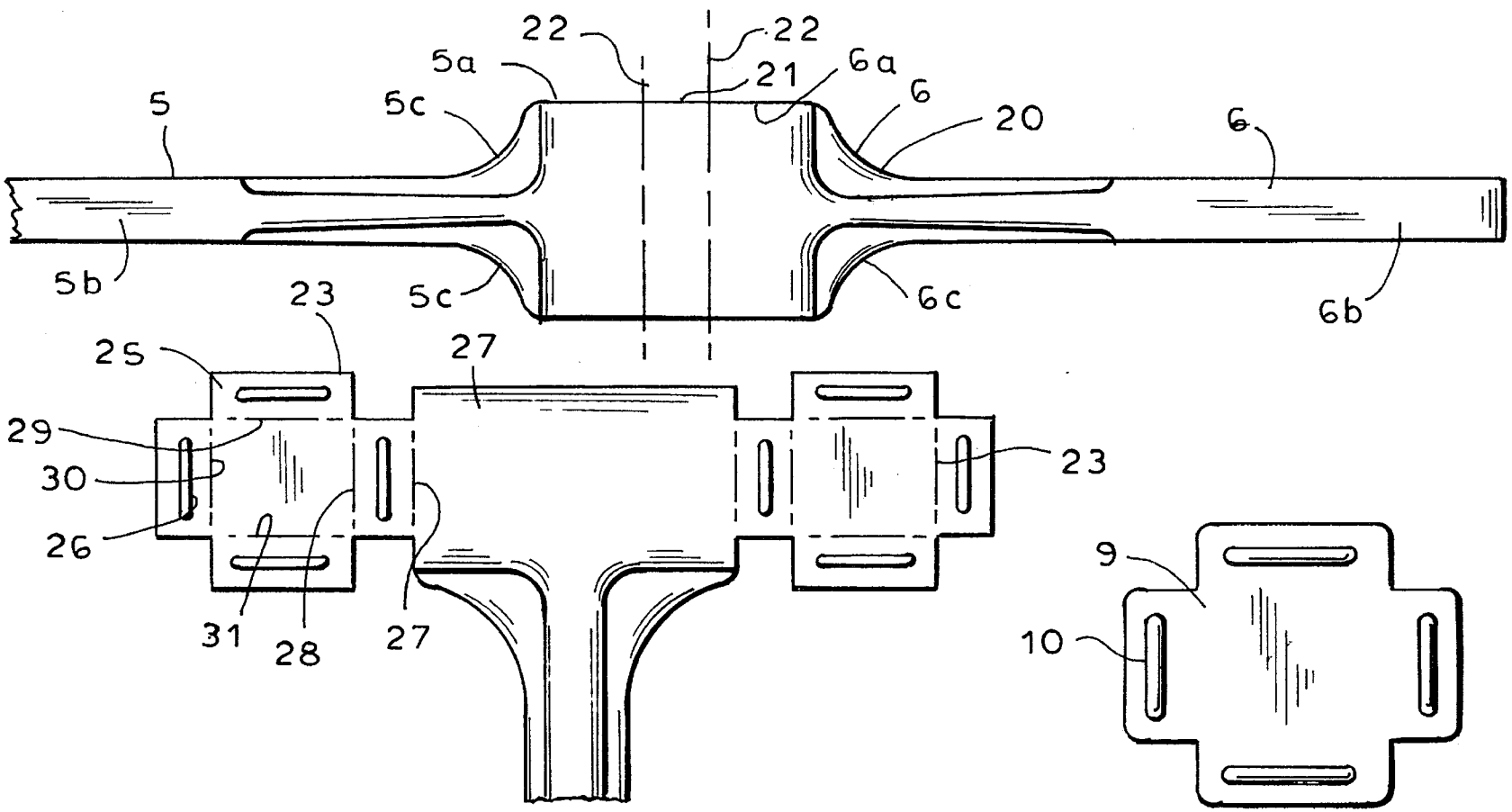
FIG. 5 is a developed view of an impact plate before it is bent or shaped to fit into the hammer.
FIG. 8 is a plan view of a blank having two interconnected shell halves for use in the practice of the invention.
FIG. 9 is a fragmentary plan view of a housing portion of a half shell unitarily provided with members forming impact plates according to the invention.

As can be seen from FIG. 8, the half shells 5 and 6 can have housing portions **5*a* and 6*a* unitary with shank portions 5*b* and 6*b* but can be unitary with one another, being stamped from a single sheet steel blank 20, being interconnected by a web 21 and being bent to lie one above the other as in FIGS. 1 and 3 along the bend lines 22 shown in dot-dash lines in FIG. 8**.

In the transition regions between the shank 3 and the housing 1, each housing portion and shank portion may be provided with a stiffening web with the two juxtaposed webs on each side of the hammer forming a respective reinforcing rib 7. The ribs 7 have weld seams at their outer edges **7*a* joining the two webs together. The webs have been represented at 5*c* and 6*c* in FIG. 8**.

When the housing 1 is assembled in the manner described, it is open at its opposite ends and the respective hammer face inserts 2 are received in these end openings. Impact plates 9 lie against the inner surfaces of the hammer face, inserts 2 and are designed to limit the wear of these inserts under the impact from the moving mass 14, e.g. metal shot. Impact plates 9 extend transversely to the axis of the housing, inwardly of the ends thereof. As can be seen from FIG. 5–7, the impact plates 9 can be separate members which are shaped and inserted into the housing. However, as can be seen for the half shell of FIG. 9, the impact plates can be formed by members 23 which are unitary with the housing portion 24 of the half shell, but which can be formed with flanges 25 and 26 adapted to be bent along the bend lines 27, 28, 29, 30 and 31 to insert the plates into the housing and support the plates against the housing with collars bent from the flanges in a manner analogous to that which applies for the plates 9 separate from the housing.

Figure 7:
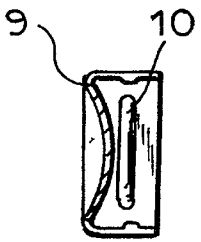
FIG. 7 is a section along the line VII—VII of FIG. 6.
Figure 6:
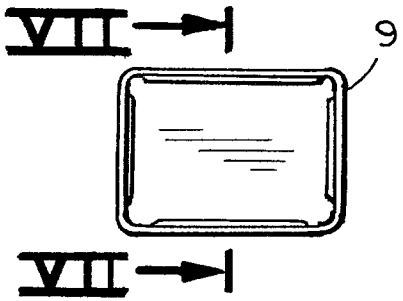
FIG. 6 is an elevational view of the impact plate after it has been shaped to be received in the housing of the hammer.
Figure 4:
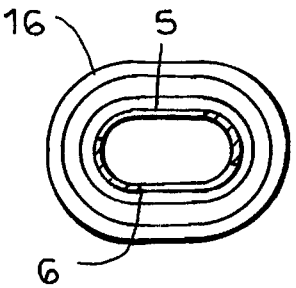
FIG. 4 is a section taken along the line IV—IV of FIG. 3.

As can be seen from FIGS. 5–7, the flanges of the impact plates 9 can be bent to form a collar which can be welded to the housing 1 along the rim of the respective opening. The impact plates 9 are formed with inwardly projecting corrugations 10 which constitute holders for the inserts 2.

The inserts 2 are held against rotation in the housing by making them of a noncircular and preferably rectangular cross section so that they can be received in a complementary, rectangular frame formed by the respective impact plate 9 and housing opening.

The housing 1 itself can have corrugations 11 which reinforce the housing walls and provide abutments against which the impact plates rest and which thus serve to position the impact plates 9 in the housing.

The shank 3 can be formed with a passage 13 opening into the housing and which enables the shot 14 to be introduced and removed, the shot serving as a rebound damping. The opening 13 can be releasably closed by a plug 15.

The hammer shaft 16 can be formed in one piece on the shank 3 and can have a surface structured sheath of plastic, rubber or the like to make the handle more comfortable to hold.

When the hammer is used to strike an object, it is swung until one of the face inserts 2 engages the object and shortly thereafter the mobile mass 14 impacts against the plate 9 abutting this insert 2 to provide the blow while the face 2 lies against the object, thereby preventing damage to the surface as is the case with earlier dead-blow mallets and hammers.

I claim:

1. A nonmarring hammer comprising:

a pair of sheet-metal half shells concave toward one another and joined along at least a portion of a periphery thereof at a junction plane with each of said half shells having a housing portion in one piece with a shank portion, said housing portions defining a hollow hammer-head housing open at opposite ends, and said shank portions defining a tubular shank extending transverse to said housing, said housing and said shank having respective longitudinal axes lying substantially in said plane;

a hammer shaft on said shank and forming a handle for said hammer;

a respective sheet-metal cup-shaped hammer face insert fixed in and closing each of said ends of said housing, having a collar fastened to the housing at the respective end, and forming an outwardly open recess, said housing having a free space between and defined partially by said inserts;

a respective impact plate lodged in each of the recesses; and a mobile mass partially filling said free space and impacting against said inserts.

2. The nonmarring hammer defined in claim 1 wherein said half shells are formed in one piece with one another in a common sheet metal blank.

3. The nonmarring hammer defined in claim 2 wherein said half shells are unitarily interconnected at said housing portions.

4. The nonmarring hammer defined in claim i wherein said half shells are welded together at least along part of said housing and shank portions.

5. The nonmarring hammer defined in claim 1 wherein said housing and said shank are reinforced at a junction between them by reinforcing ribs formed by edge strips of said half shells, respective edge strips on opposite sides of the hammer abutting in said plane and being welded together along respective free edges.

6. The nonmarring hammer defined in claim 1 wherein each of said impact plates has inwardly projecting corrugations for anchoring the respective insert.

7. The nonmarring hammer defined in claim 1 wherein said impact plates are formed unitarily with said half shells.

8. The nonmarring hammer defined in claim 1 wherein said shank is formed with a passage communicating with said housing for introducing said mass into said housing.

9. The nonmarring hammer defined in claim 8 wherein said hammer further comprises a releasable plug for closing said passage.

10. The nonmarring hammer defined in claim 1 wherein said insert has a noncircular cross section received in said housing and preventing rotation of said insert relative to said housing.

11. The nonmarring hammer defined in claim 10 wherein said cross section of said insert is rectangular and said open end of said housing has a rectangular shape complementary to said cross section.

12. The nonmarring hammer defined in claim 1 wherein said housing is formed with walls provided with stiffening corrugations.

13. The nonmarring hammer defined in claim 12 wherein said corrugations are oriented parallel to an edge of said open end and form abutments for an impact plate received in said housing and in which said insert is lodged.

14. The nonmarring hammer defined in claim 1 wherein said hammer shaft is formed in one piece on said shank.

* * * * *